United States Patent [19]

Thompson

[11] Patent Number: 4,726,973

[45] Date of Patent: Feb. 23, 1988

[54] LAMINATED SUBDIVIDABLE PANEL

[76] Inventor: Gerald M. Thompson, 1437 Creekside Dr., Wheaton, Ill. 60187

[21] Appl. No.: 20,868

[22] Filed: Mar. 2, 1987

[51] Int. Cl.[4] ..... B32B 3/00; B32B 3/26; B24B 7/00

[52] U.S. Cl. ..... 428/45; 52/98; 52/309.8; 428/71; 428/76; 428/316.6

[58] Field of Search ..... 52/98, 309.7, 309.8, 52/309.9; 428/45, 47, 48, 71, 76, 316.6

[56] References Cited

U.S. PATENT DOCUMENTS

| | | | |
|---|---|---|---|
| 2,231,216 | 2/1941 | Nystrom | 52/787 |
| 2,270,419 | 1/1942 | Debo | 52/105 |
| 3,331,174 | 7/1967 | Wesch et al. | 52/309.11 |
| 3,471,984 | 10/1969 | Hayes | 52/309.11 |
| 3,544,417 | 12/1970 | Corzine | 428/71 |
| 3,841,958 | 10/1974 | Delorme | 428/116 |
| 3,899,860 | 8/1975 | Newell | 428/45 |
| 4,281,493 | 8/1981 | Pitt | 428/45 |
| 4,294,051 | 10/1981 | Hughes, Jr. | 52/98 |
| 4,351,870 | 9/1982 | English, Jr. | 428/174 |

*Primary Examiner*—William J. Van Balen
*Attorney, Agent, or Firm*—Clement and Ryan

[57] ABSTRACT

A laminated master panel having a predetermined shape and predetermined dimensions, which panel comprises a foam core made up of a plurality of separate, rigid, constituent segments, an original perimeter frame, and at least one interior divider member. Transverse interior divider members may also be included. Through careful positioning of the interior divider member or members, the panel is dividable into a plurality of smaller laminated panels each of which has a predetermined shape and dimensions that are predetermined proportions of the dimensions of the master panel. In addition, the resulting perimeter frame of each subdivided panel has substantially the same thickness, and substantially the same surface characteristics, throughout the extent of its perimeter. The predetermined shapes of the subdivided panels may be any desired shape—rectangular, square, triangular, trapezoidal, a parallelogram, circular, etc.

12 Claims, 13 Drawing Figures

FIG. 1
PRIOR ART
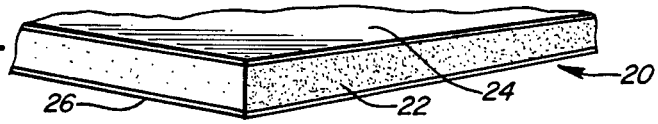
FIG. 2
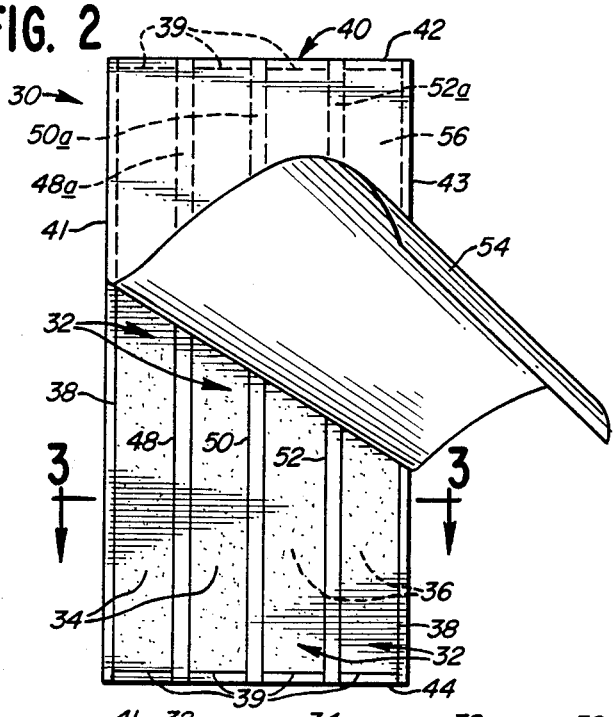
FIG. 4
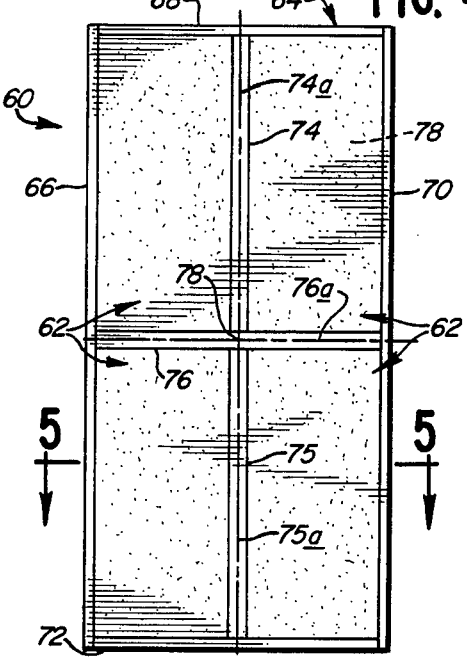
FIG. 3
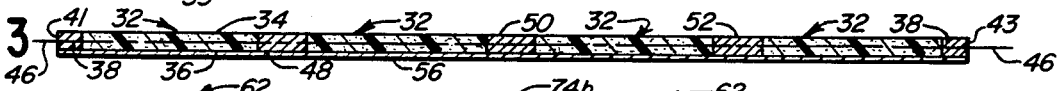
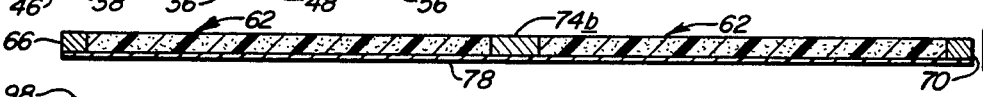
FIG. 5
FIG. 6
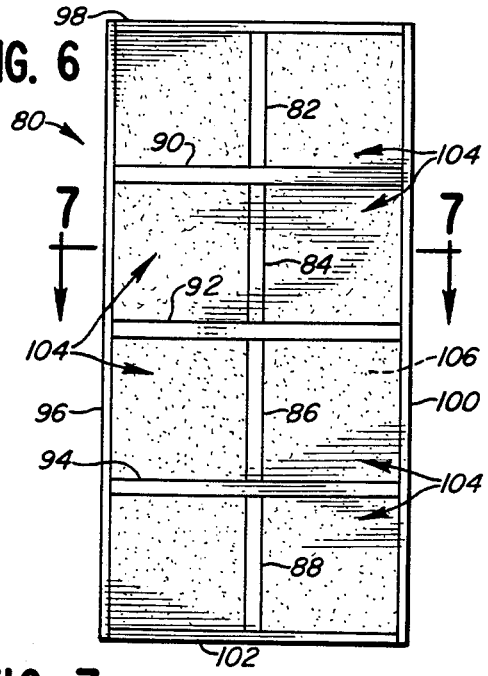
FIG. 8
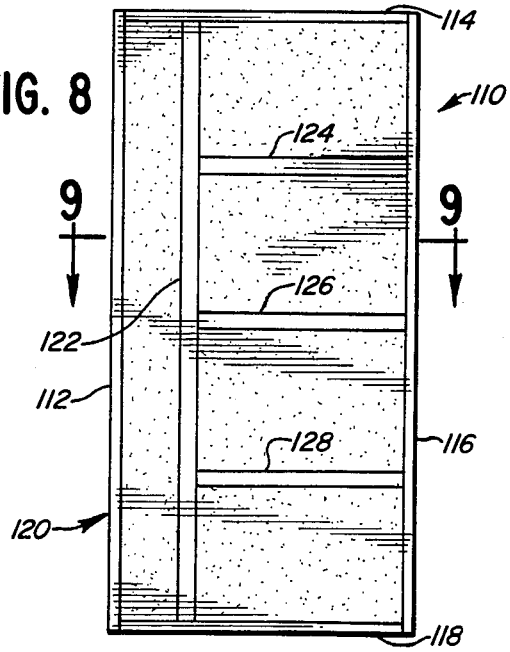
FIG. 7
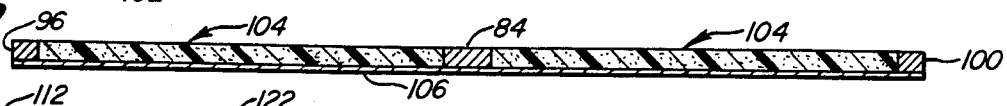
FIG. 9
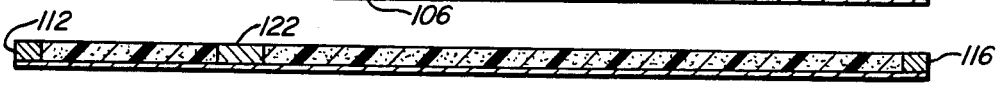

LAMINATED SUBDIVIDABLE PANEL

This invention relates to a laminated master panel, and more particularly to such a panel having a predetermined shape and predetermined dimensions, which is readily subdividable into a preplanned combination of smaller laminated panels each of which has a predetermined shape and dimensions that are predetermined proportions of the master panel predetermined dimensions.

BACKGROUND OF THE INVENTION

Laminated panels of a number of different types—basically including a core formed of a foam or similar material with thin face layers on each surface of the core—have been used as building materials and structural members for a great many years. U.S. Pat. Nos. 2,231,216, 3,331,174, 3,471,984, 3,544,417, 3,841,958 and 4,351,870 provide examples over more than four decades of the great variety of such laminated panels that have been used.

Actually, these patents provide only limited illustrations of laminated panels that have been in use in the past, for laminated panels have been known for a much longer period of time than the period to which the patents relate—since at least about 1920, and probably much earlier. Some of these panels have had spacer members of one type or another in the panel interior, but none so far as is known have ever had the particular type of interior divider that is utilized in the laminated panels of the present invention.

Over the years, laminated panels have been provided in a myriad of shapes and dimensions. So far as applicant is aware, in every case such panels have been individually and specifically made in exact sizes as dictated by the requirements of a particular job.

By a novel use of perimeter frames and cross braces to form a standard master laminated panel of unique construction, the present invention makes it possible to produce predetermined combinations of laminated panels in predetermined shapes and sizes smaller than the original standard master panel, but at the same time to retain the advantages of convenience and economy that are achieved by shipping master panels in a standard size, and only thereafter dividing such panels at the user site into smaller ultimate panels of the desired sizes and configurations.

SUMMARY OF THE INVENTION

The laminated master panel of this invention includes a foam core comprising a plurality of separate, rigid, constituent segments that taken together have two laterally and longitudinally extending, exterior planar surfaces, an original perimeter frame, at least one principal interior divider member, and a thin face layer secured to each of the laterally and longitudinally extending exterior surfaces of the foam core as well as to the original perimeter members and to said at least one divider member. All the original perimeter frame members, principal interior divider members, and rigid foam core segments have the same predetermined thickness, and all the original perimeter frame members have an outwardly facing exterior surface with substantially the same surface characteristics.

Each principal interior divider member has a separation line that delineates a portion of the perimeter of at least one subdivided laminated panel, and is severable along that line to produce at least one subdivided perimeter member. Each of these subdivided perimeter members (1) delineates a portion of the perimeter of a subdivided laminated panel of a predetermined shape, and (2) has an outwardly facing exterior surface that has substantially the same thickness and substantially the same surface characteristics as the outwardly facing exterior surfaces of the original perimeter members. The predetermined shape of the subdivided panel may be rectangular, square, triangular, trapezoidal, a parallelogram, circular or other desired shape.

At least one transverse interior divider member having characteristics similar to the principal divider member or members may also be included in the master panel of this invention.

The invention will now be described in more detail by reference to the accompanying drawing.

BRIEF DESCRIPTION OF THE DRAWING

FIG. 1 is a fragmentary perspective view of a conventional laminated panel consisting of an integrally formed foam core extending throughout the interior of the panel, with two thin skin layers on the opposite exterior surfaces of the panel, and no perimeter frame members or interior cross braces;

FIG. 2 is a top plan view of one embodiment of the laminated master panel of this invention in which the smaller, subdivided panels are all rectangular in shape, with a portion of the top skin layer pulled back to disclose the inner framework of the panel;

FIG. 3 is an enlarged sectional view of the laminated master panel of FIG. 2, taken along line 3—3 in the latter Figure;

FIGS. 4, 6 and 8 are top plan views of other embodiments of the laminated master panel of this invention in which the smaller, subdivided panels are rectangular or square, with the top skin layer removed entirely in each case;

FIGS. 5, 7 and 9 are sectional views of the laminated master panels of FIGS. 4, 6 and 8, respectively, taken along lines 5—5, 7—7 and 9—9 in the latter Figures;

DETAILED DESCRIPTION OF SEVERAL EMBODIMENTS OF THE INVENTION

Prior Art Panel

Figure 10:
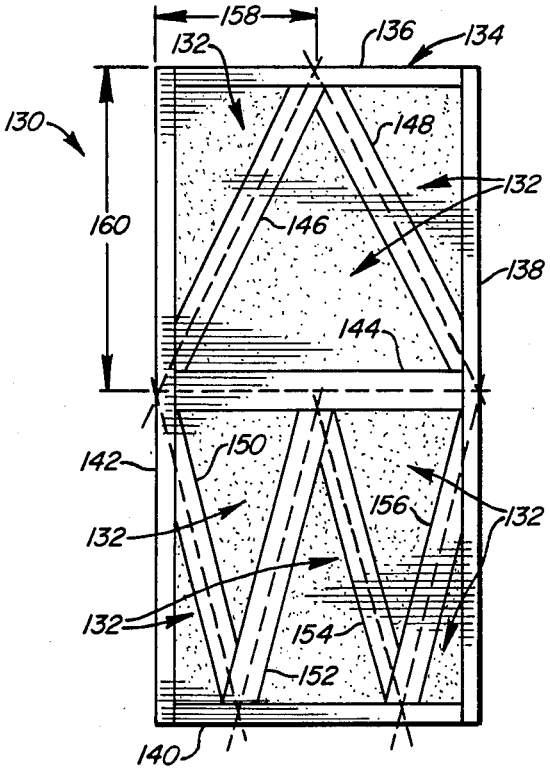
FIG. 10 is a view similar to FIGS. 4, 6 and 8 of another embodiment of the laminated master panel of this invention in which the smaller, subdivided panels are all triangular in shape.

FIG. 1 is a fragmentary perspective view of a conventional laminated panel 20 of a type long known in the prior art. Panel 20 consists of integrally formed foam core 22 which extends throughout the interior of the panel, and two thin face layers 24 and 26 on opposite exterior surfaces of the panel.

Foam core 22 is formed of a suitable foamed plastic material, and thin face layers 24 and 26 are formed of a suitable resin-impregnated paper. When these materials are bonded together with adhesive, a panel having substantial strength and rigidity is formed.

Such panels, which find many uses in display racks, signage, and in various other structures, are enlarged commonly produced and used without any perimeter frame or interior cross braces of wood, particle board, or other similar material. And, so far as applicant is aware, no such prior art panels have ever included perimeter frames and cross braces arranged and disposed in the novel manner invented by applicant that is disclosed and claimed in this application.

Dividable Laminated Master Panel

The panel of this invention is a laminated master panel of predetermined shape and predetermined dimensions that is dividable with great convenience and efficient use of materials into combinations of smaller laminated panels of predetermined shapes having dimensions that are predetermined proportions of the master panel predetermined dimensions.

The embodiments of the master panel of this invention that will be first described, by reference to FIGS. 2–9 of the drawing, are those in which the predetermined shapes of the smaller subdivided panels are all rectangular. In these embodiments, as well as with the embodiments illustrated in FIGS. 10–13, the master panel is rectangular in shape, as is typically (but not necessarily) the case.

Foam Core

FIG. 2 is a top plan view of one embodiment 30 of the laminated master panel of this invention. Laminated master panel 30 is comprised of separate constituent segments of rigid, rectangular foam core 32 which taken together have upper laterally and longitudinally extending, exterior planar surface 34 and lower laterally and longitudinally extending, exterior planar surface 36 (the latter on the remote side of core 32 in FIG. 2). Foam core exterior planar surfaces 34 and 36 are parallel to each other, and thus the foam core has the same thickness throughout its extent.

The segments that together make up foam core 32 have two outer side edges 38 and two outer end edges 39. The surfaces of all edges 38 and 39 are perpendicular to exterior surfaces 34 and 36 of foam core 32.

Foam core 32 is preferably formed of a temperature insulating and sound dampening material, and should be resistant to water absorption as well. The material of which core 32 is formed is suitably a rigid foamed sheet of modified, expanded, closed cell polystyrene having a density of approximately 1 to 2 lbs. per cubic foot. A similar raw material can be used in extruded form, which will result in a smaller cell structure that is better adapted to some applications. Still another suitable material for formation of core 32 is a foam of chlorofluorcarbon, or a modified polyisocyanurate, having a density of about 1½ lbs. per cubic foot.

Original Perimeter Frame

Original perimeter frame 40 includes four separate, rigid, integrally formed members 41, 42, 43 and 44 of rectangular cross section (which cross section is best seen in FIG. 3). Original perimeter frame members 41–44 together define the outer edges of rectangular laminated master panel 30. Each original perimeter member 41–44 either abuts one of outer side edges 38 or abuts one of outer end edges 39 of foam core 32.

Each original perimeter frame member 41–44 has the same predetermined thickness measured perpendicularly to median plane 46 (seen, for example, in FIG. 3) of the original perimeter frame 40, which is the same thickness as the uniform thickness of foam core 32. Each original perimeter frame member preferably has substantially the same width as every other original perimeter frame member. All original perimeter frame members 41–44 have an exterior surface facing outwardly from rectangular laminated master panel 30 that has substantially the same surface characteristics as all the other members of frame 40.

Original perimeter frame members 41–44 may suitably be formed of particle board, i.e., a board formed of non-oriented wood fiber particles pressed into a single sheet. This material commonly has a density of approximately 45 lbs. per cubic foot. Natural hard woods such as poplar, obechi or other straight, close grained woods that are warp resistant when kiln dried may also be used.

Longitudinal Interior Divider Members

Master panel 30 has at least one principal interior divider member—in the embodiment of FIGS. 2 and 3, three such members—of rectangular cross section taken perpendicularly to the median plane of the master panel. Each longitudinal interior divider member 48, 50 and 52 is integrally formed of a rigid solid material, suitably the same material as the material of which perimeter frame members 41–44 are formed.

Interior divider members 48, 50 and 52 abut adjoining constituent segments of foam core 32. Each of these divider members has the same thickness, measured perpendicularly to median plane 46, as do original perimeter members 41–44. As shown in FIGS. 2 and 3, each interior divider member 48, 50 and 52 is wider than each original perimeter member 41–44. The width of each interior divider member is preferably substantially two times the width of each original perimeter frame member 41–44, so that when an interior divider member is severed along its longitudinal center line (as described below), its width will be substantially the same as the width of an original perimeter member.

As will be seen from FIG. 2, interior divider members 48, 50 and 52 are positioned parallel to the outer edge of original perimeter member 41 along the left side of laminated panel 30.

Original perimeter members 41–44 and divider members 48, 50 and 52 are secured to each other to form a rigid frame. The members referred to may also be secured to the separate constituent segments of foam core 32.

Interior Divider Member Longitudinal Center Lines

Interior divider members 48, 50 and 52 have longitudinal center lines or separation lines 48*a*, 50*a* and 52*a*, respectively. Each center or separation line, like its associated divider member, is parallel to the outer side edge of member 41 of original perimeter frame member 44.

In the embodiment of FIG. 2, center line 48*a* is located at a distance from the leftmost side edge of master panel 30, defined by the outer edge of original perimeter frame member 41, that is a predetermined proportion of the predetermined width of master panel 30. In this case the predetermined proportion or fraction is substantially ¼. Center line 50*a* is spaced from the leftmost side edge of master panel 30 by another predetermined fraction—in this case, substantially ½—of the predetermined panel width, and center line 50*c* is spaced from the leftmost outer edge of member 40 by a distance that is substantially ¾ of the predetermined panel width.

Each of the interior divider members 48, 50 and 52 is severable along its respective center line to produce two subdivided perimeter members each of which has an outwardly facing exterior surface with substantially the same dimension, measured perpendicularly to original perimeter frame median plane 46, and substantially the same surface characteristics, as the outwardly facing exterior surfaces of original perimeter members 41–44.

Thin Face Layers

Thin face layer 54 is secured to upper exterior surface 34 of foam core 32, to original perimeter members 41–44, and to interior divider members 48, 50 and 52. In FIG. 2, a portion of face layer 54 is shown peeled back to expose foam core 32, the original perimeter members, and the interior divider members.

Thin face layer 56 is secured to exterior surface 36 of foam core 32, which is located on the remote side of core 32 in FIG. 2 and on the lower side of core 32 in FIG. 3. The borders of face layers 54 and 56 coincide with the edges of master panel 30 that are formed by the outwardly facing exterior surfaces of original perimeter frame members 41–44.

Face layers 54 and 56 may be formed of any suitable strong, resin-saturated paper. Kraft paper with an oriented wood fiber content of at least about 65 percent and the remainder a synthetic phenolic or urea resin, having a total weight of approximately 156–183 lbs. per 3,000 square feet, may be used to advantage. The paper sold by International Paper Company under the trademark LUXCELL and the paper sold by Reichhold Chemicals, Inc. under the trademark METRON are examples of papers that are suitable for use in the laminated panel of this invention.

Subdividing of Laminated Panel of this Invention

After the laminated master panel of this invention illustrated in FIG. 2 has been transported to the user, it can be readily subdivided into a plurality of smaller rectangular laminated panels each of which has its own predetermined length and predetermined width.

The laminated master panel of this invention is typically manufactured in a size 4′ wide and 8′ or 10′ long. Thus, as will be seen, severing one or more of interior divider members 48, 50 and 52 along their respective center lines or separation lines will produce a plurality of rectangular laminated subdivided panels each of which has a length that is a first predetermined proportion of the predetermined length of rectangular laminated master panel 30, and a width that is a second predetermined proportion of the predetermined width of master panel 30.

If the master panel is 4′×8′ in size and each interior divider member 48, 50 and 52 is severed along its respective center line, the resulting rectangular laminated panels will all have a first predetermined length that is equal to the predetermined length of master panel 30 (i.e., 8′), and a width that is substantially ¼ of the predetermined width of master panel 30 (i.e., 1′). If only interior divider member 50 is severed along its center line **50*a*, the width of the two resulting panels will be ½ the predetermined width of master panel 30 (i.e., 2′). If only interior divider member 48 or 52 is severed along its respective center line, one of the resulting panels will have a width that is ¼ the predetermined width of master panel 30 (i.e., 1′), and the other will have a width that is ¾ the predetermined width of master panel 30** (i.e., 3′).

As will be seen, the perimeter of each of these ultimate laminated panels will include a portion of original perimeter frame 40 and at least one perimeter member that has been subdivided from one of the interior divider members. All these ultimate perimeter members, wehther part or all of original perimeter members 41, 42, 43 or 44, or a subdivided part of divider members 48, 50 or 52, will have an outwardly facing exterior surface with the same thickness, and the same surface characteristics, throughout the extent of the perimeter of the resulting subdivided rectangular laminated panel.

Transverse Interior Divider Members

FIGS. 4, 6 and 8 illustrate rectangular laminated master panels according to this invention that include at least one transverse interior divider member.

Rectangular laminated master panel 60 in FIG. 4, for example, includes foam core 62, made up of four constituent segments, that is bounded by original perimeter frame 64, which comprises perimeter frame members 66, 68, 70 and 72 on the four sides of panel 60.

Interior divider member 74/75 is positioned parallel to original perimeter member 66. Transverse interior divider member 76 is positioned perpendicularly to interior divider member 74/75, and thus also to original perimeter member 66. Original perimeter members 66, 68, 70 and 72, interior divider member 74/75, and transverse interior divider member 76 are all secured to each to form a rigid frame.

The top face layer of rectangular laminated master panel 60 is omitted for clarity in FIG. 4. Bottom face layer 78 is secured to the remote exterior surface of master panel 60 as illustrated in FIG. 4, and this face layer is shown at the bottom of FIG. 5.

Each interior dividing member such as member 76 abuts at least two constituent segments of the foam core—thus, in FIG. 4, member 76 abuts four constituent segments of foam core 62. Transverse interior divider member 76 has the same thickness, measured perpendicularly to the median plane of the original perimeter frame, as original perimeter members 66, 68, 70 and 72.

Divider member 76 has a center line **76*a* spaced from the outer edge of original perimeter member 68 (which is perpendicular to original perimeter member 66) by a distance that is a predetermined fraction of the length of rectangular laminated master panel 60. In the embodiment of FIG. 4, that predetermined fraction is substantially ½. Transverse divider member 76 is severable along center line 76*a***.

As will be seen, when rectangular laminated master panel 60 is manufactured in a size 4′ wide and 8′ long, severing interior divider member 74/75 along its center line **74*a*/75*a* will produce two rectangular laminated subdivided panels each of which has a length that is the same as the predetermined length of master panel 60 (i.e., 8′), and a width that is ½ the predetermined width of panel 60 (i.e., 2′). Severing interior divider member 74/75 along its respective center line 74*a*/75*a* will of course require that transverse interior divider member 76 be cut transversely at its longitudinal center 78**.

If only transverse interior divider member 76 is severed along its longitudinal center line **76*a*, the resulting rectangular laminated panels will each have the same width as the predetermined width of master panel 60 (i.e., 4′), and substantially ½ the predetermined length of master panel 60 (also 4′). If both interior divider members 74/75 and 76** are divided along their respective longitudinal center lines, the resulting four rectangular laminated panels will all have a length and width substantially ½ the predetermined length and width, respectively, of original rectangular laminated master panel 60 (i.e., 4'×2').

In all these cases, the perimeter of each of the ultimate laminated panels will include a portion of original perimeter frame 64 and at least one perimeter member that has been subdivided from one of the interior divider members, whether a longitudinal or a transverse divider member. All these ultimate perimeter members will have an outwardly facing exterior surface with the same thickness and the same surface characteristics throughout the extent of the perimeter of the resulting subdivided rectangular laminated panel.

The rectangular laminated master panel of this invention illustrated in FIG. 6 has an interior divider member extending lengthwise of panel 80 that is made up of interior divider members 82, 84, 86 and 88. In addition, master panel 80 has transverse interior divider members 90, 92 and 94. All these interior divider members are secured to each other as shown in FIG. 6, and to original perimeter frame members 96, 98, 100 and 102.

The upper face layer of rectangular laminated master panel 80 is omitted from FIG. 6 in order to expose the interior divider members and foam core constituent segments 104. Face layer 106, secured to the remote exterior surface of foam core constituent segments 104, is seen in FIG. 7.

As will be seen from FIG. 6, severing all transverse interior divider members 90, 92 and 94 along their respective center lines or separation lines will produce rectangular laminated panels each of which has one dimension that is the same as the predetermined width of the rectangular laminated master panel 80, and a second dimension in the transverse direction that is substantially ¼ of the predetermined length of master panel 80. Depending upon which interior divider members are severed along their respective longitudinal center lines, an original rectangular laminated master panel measuring 4' by 8' could alternatively be subdivided into eight panels each of which is 2' by 2', two panels that are 4' by 4', or one panel that is 4' by 6' and a second panel that is 2' by 4'.

Again, the perimeter members outlining these various possible combinations of laminated panels of various sizes will have an outwardly facing exterior surface with the same thickness, and the same surface characteristics, throughout the extent of the ultimate perimeter frame of the panel.

Still another possible positioning of interior divider panels is illustrated in rectangular laminated master panel 110 in FIG. 8. In master panel 110, original perimeter members 112, 114, 116 and 118 comprise original perimeter frame 120. Interior divider member 122 extends lengthwise of panel 110, and transverse interior divider members 124, 126 and 128 are positioned perpendicularly to member 122.

Various sizes of rectangular laminated panels can be produced from master panel 110 according to the selection of the interior divider members that are to be severed along their respective longitudinal center lines. As will be seen, if all the illustrated interior divider members are severed in an original master panel that measures 4' by 8', one panel that measures 1' by 8' and four panels that measure 2' by 3' will be produced. Once again, the ultimate perimeter members of all these panels will have an outwardly facing exterior surface with the same thickness and the same surface characteristics throughout their extent.

By carefully positioning the interior divider members, whether extending lengthwise or in the transverse direction, in this novel way within the foam core interior of the laminated master panel of this invention, a plurality of smaller laminated panels of whatever dimensions desired can be conveniently and efficiently produced. The laminated master panel of this invention has a predetermined length and width, and by careful positioning of the interior divider members, as described above, it can be subdivided into a plurality of smaller panels each of which has a length and a width that are predetermined proportions of the predetermined length and width, respectively, of the original master panel.

Subdivided Laminated Panels of Other Predetermined Shapes

FIGS. 10–13 illustrate laminated master panels according to this invention in which the smaller, subdivided laminated panels produced from the master panel have various shapes other than rectangles.

In FIG. 10, laminated master panel 130 includes foam core 132, made up of eight constituent triangular segments, that is bounded by original perimeter frame 134, which comprises perimeter frame members 136, 138, 140 and 142 on the four sides of panel 130.

Interior divider member 144 is positioned parallel to original perimeter member 136. Other interior divider members 146, 148, 150, 152, 154 and 156 further subdivide foam core 132 into various triangular shapes.

In each case, the longitudinal center lines or separation lines (shown in dashes in FIG. 10) of the interior divider members are located with respect to perimeter members 136, 138, 140 and 142 in positions that produce bases and altitudes for the triangles in question that are predetermined proportions of the predetermined length and width of master panel 130. The subdivided laminated panels in the upper left- and right-hand portions of FIG. 10, for example, have the shape of an inverted triangle with a base 158 that is substantially one-half the predetermined width of master panel 130 and an altitude 160 that is substantially one-half the predetermined length of master panel 130.

Figure 11:
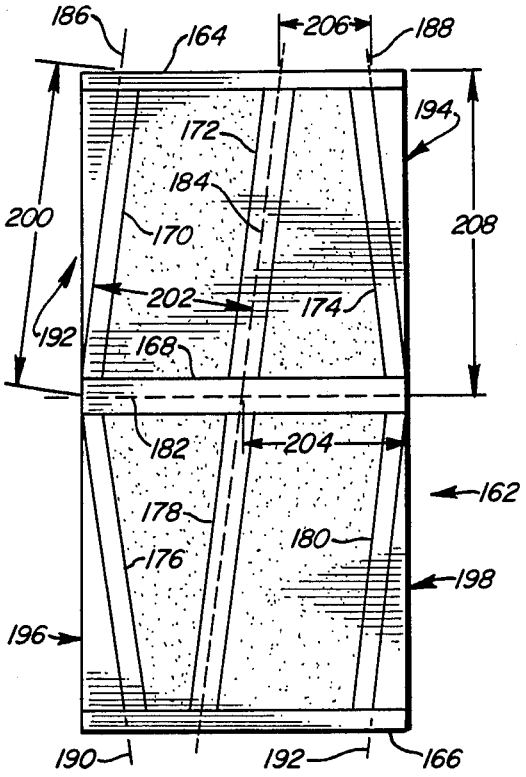
FIG. 11 is a similar view of another embodiment of the laminated master panel of this invention in which the smaller, subdivided panels are parallelograms and trapezoids.

In FIG. 11, laminated master panel 162 includes two original perimeter members 164 and 166, together with interior divider member 168 positioned parallel to member 164, and transverse interior divider members 170, 172, 174, 176, 178 and 180. Additional original perimeter members may, if desired, be included at the left- and right-hand edges of master panel 162 as shown in FIG. 11.

Longitudinal center line or separation line 182 on interior divider member 168 and longitudinal center line or separation line 184 on transverse divider members 172 and 178 are shown in dashed lines. Additional cut lines or separation lines 186, 188, 190 and 192 for transverse interior divider members 170, 174, 176 and 180, respectively, are shown partially in dashed lines and partially in solid lines. As will be seen, in this embodiment the separation lines for the transverse interior divider members may either be contained within the divider member (i.e., divider members 172 and 178) or lie immediately adjacent those members (e.g., divider members 170, 174, 176 and 180).

Severing master panel 162 along the indicated longitudinal center lines and cut lines will produce two subdivided laminated panels in the form of parallelograms, and two in the form of trapezoids. As will be seen, in this embodiment (contrary to the situation with the embodiments of FIGS. 2–9) there is some waste material 192, 194, 196 and 198 at each corner of the master panel.

With this embodiment of the laminated master panel of this invention, each parallelogram that results from cutting panel 162 as described has a base 200 that is slightly greater than one-half the predetermined length of the master panel, and an altitude 202 that is slightly less than one-half the predetermined width of the master panel. Each trapezoid formed as described has a long parallel side 204 substantially equal to one-half the predetermined width of master panel 162, a shorter parallel side 206 that is something more than one-fourth the predetermined width of panel 162, and an altitude 208 that is substantially equal to one-half the predetermined length of panel 162.

Figure 12:
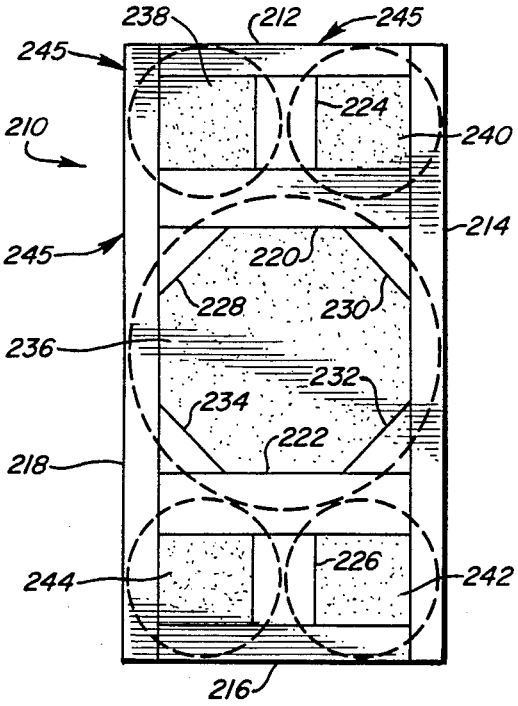
FIGS. 12 and 13 are similar views of other embodiments of the laminated panel of this invention in which the smaller, subdivided panels are circular in shape.

In FIG. 12, laminated master panel 210 includes original perimeter members 212, 214, 216 and 218. It also includes principal interior divider members 220 and 222, as well as transverse divider members 224 and 226. These members, together with additional blocks 228, 230, 232 and 234 are all secured together to form the frame for laminated master panel 210.

When the various members of this frame are severed along the cut lines or separation lines shown in dashed lines in FIG. 12, one large circular subdivided laminated panel 236 and four smaller circular subdivided panels 238–244 are produced. As will be seen, here again there is some waste material (indicated at 245, for example) remaining after production of circular laminated panels 236 and 238–244.

Figure 13:
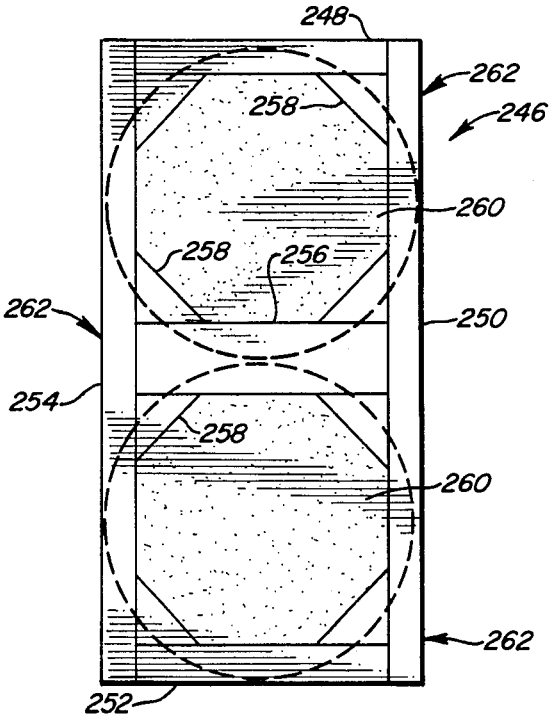

In FIG. 13, the frame for laminated master panel 246 is comprised of four original perimeter members 248, 250, 252 and 254, one interior divider member 256 and eight interior block members 258. All these members are secured to each other to form a rigid frame.

Severing the various members of the frame along the cut lines or separation lines shown in dashed lines in FIG. 13 will produce two large subdivided laminated panels 260, with a certain amount of waste material 262 remaining.

In the embodiments of FIGS. 12 and 13, the larger circular subdivided panels 236 and 260, respectively, have diameters slightly less than the predetermined width of the master panel from which the subdivided panels are produced. Smaller circular laminated panels 238–244 in the embodiment of FIG. 12 have diameters slightly less than one-half the predetermined width of master panel 210.

Manufacture of Laminated Panel of This Invention

In one convenient method of manufacture of the laminated panel of this invention, the rigid perimeter frame and interior divider member or members are first secured and the constituent segments of the foam core are then put in place. This assembly is then passed through a conventional glue roller, after which the frame and foam core are placed on the bottom face layer which has been spread out flat, following which the top face layer is placed on the assembled frame and core.

This assemblage of members is subjected to pressure to cure the adhesive employed, which may be any suitable, exterior adhesive that causes the various members of the assemblage to adhere to each other. Finally, the edges of the paper face layers are trimmed to the same outer dimensions as the rigid frame to which they are secured.

The above detailed description has been given for ease of understanding only. No unnecessary limitations should be understood therefrom, as modifications will be obvious to those skilled in the art.

I claim:

1. A laminated master panel having a predetermined shape and predetermined dimensions, said panel being dividable into a plurality of smaller, subdivided, laminated panels each of which has a substantially uniform thickness, a predetermined shape, and dimensions that are predetermined proportions of said master panel predetermined dimensions, which comprises:

(a) a foam core comprising a plurality of separate, rigid, constituent segments each having the same predetermined thickness, measured perpendicularly to the median plane of said foam core, said constituent segments taken together having two parallel, laterally and longitudinally extending, exterior planar surfaces and an outer edge;

(b) an original perimeter frame including a plurality of separate, rigid, integrally formed members that together define the outer edge of said laminated master panel, each of said plurality of original perimeter frame members abutting said outer edge of said foam core, all of said original perimeter members having substantially the same predetermined thickness, measured perpendicularly to the median plane of said frame, as said foam core constituent segments do, and all having an outwardly facing exterior surface with substantially the same surface characteristics;

(c) at least one principal interior divider member integrally formed of a rigid solid material, said at least one divider member (i) abutting at least one of said constituent segments of said foam core, (ii) having substantially the same thickness, measured perpendicularly to said median plane of the original perimeter frame, as said original perimeter members, (iii) containing at least one separation line that delineates a portion of the perimeter of at least one of said smaller, subdivided laminated panels, each of said subdivided panels having a predetermined shape and dimensions that are predetermined proportions of said master panel predetermined dimensions, and (iv) being severable along said separation line to produce at least one subdivided perimeter member each of which has an outwardly facing exterior surface with substantially the same dimension measured perpendicularly to said median plane of the original perimeter frame, and substantially the same surface characteristics, as said outwardly facing exterior surfaces of said original perimeter members, said original perimeter members and said at least one principal interior divider member being secured to each other to form a rigid over-all frame; and (d) a thin face layer secured (i) to each of said laterally and longitudinally extending exterior surfaces of said foam core, (ii) to said original perimeter members, and (iii) to said at least one principal interior divider member, the borders of each of said face layers coinciding with the outer edge of said laminated master panel that is formed by said outwardly facing exterior surfaces of the members of said original perimeter frame, whereby severing said at least one principal interior divider member along its said separation line will produce at least one smaller, subdivided laminated panel, each of which subdivided panels has (i) a predetermined shape, (ii) dimensions that are predetermined proportions of said master panel predetermined dimensions, and (iii) a perimeter that has an outwardly facing exterior surface with substantially the same thickness measured perpendicularly to the median plane of said subdivided panel, and substantially the same surface characteristics, throughout its extent.

2. The laminated master panel of claim 1 in which the width of each of said at least one interior divider member, measured parallel to said median plane of said original perimeter frame, is greater than its thickness, measured in the direction perpendicular to said median frame.

3. The laminated master panel of claim 1 in which:

(a) the width of each of said original perimeter frame members is substantially the same as the width of every other one of said members; and (b) the width of each of said at least one principal interior divider member is substantially two times the width of each of said original perimeter frame members.

4. The laminated master panel of claim 1 which includes at least one transverse interior divider member of rectangular cross section and integrally formed of a rigid solid material, said at least one transverse divider member (a) abutting at least two of said constituent segments of said foam core, (b) having the same thickness, measured perpendicularly to said original perimeter frame median plane, as said original perimeter members, (c) being positioned transversely to said first mentioned at least one principal interior divider member, (d) having a separation line that delineates a portion of the perimeter of one of said smaller, subdivided laminated panels, and (e) being severable along said separation line to produce at least one subdivided perimeter member each of which members has an outwardly facing exterior surface with substantially the same thickness measured perpendicularly to said median plane of the original perimeter frame, and substantially the same surface characteristics, as the aforementioned outwardly facing exterior surfaces of said original perimeter members, whereby severing said first mentioned at least one principal interior divider member and said at least one transverse interior divider member along their respective separation lines will produce a plurality of laminated subdivided panels, each of which subdivided panels has (i) a predetermined shape, (ii) dimensions that are predetermined proportions of said master panel predetermined dimensions, and (iii) a perimeter that has an outwardly facing exterior surface with substantially the same thickness measured perpendicularlly to said median plane of the original perimeter frame, and substantially the same surface characteristics, throughout its extent.

5. The laminated master panel of claim 1 which is rectangular in shape and in which said at least one principal interior divider member (a) is an elongated rectangle in shape, (b) is positioned parallel to a given one of said original perimeter members, (c) has a longitudinal center line, said center line being spaced from the edge of said panel defined by said given parallel original perimeter member by a distance that is a predetermined fraction of one of said predetermined panel length and panel width, and (d) is severable along said center line to produce two subdivided perimeter members each of which has an outwardly facing exterior surface with substantially the same dimension measured perpendicularly to said median plane of the original perimeter frame, and substantially the same surface characteristics, as said outwardly facing exterior surfaces of said original perimeter members, whereby severing said at least one principal interior divider member along its said longitudinal center line will produce a plurality of rectangular laminated subdivided panels, each of which subdivided panels has (i) a first dimension that is a first predetermined proportion of said predetermined length of said rectangular laminated master panel, (ii) a second dimension perpendicular to said first dimension that is a second predetermined proportion of said predetermined width of said master panel, and (iii) a perimeter that includes a portion of said original perimeter frame and at least one of the aforementioned subdivided perimeter members, and has an outwardly facing exterior surface with substantially the same thickness, and substantially the same surface characteristics, throughout its extent.

6. The rectangular laminated master panel of claim 5 in which the width of each of said at least one principal interior divider member, measured parallel to said median plane of said original perimeter frame, is greater than its thickness, measured in the direction perpendicular to said median frame.

7. The rectangular laminated master panel of claim 5 in which:

(a) the width of each of said original perimeter frame members is substantially the same as the width of every other one of said members; and (b) the width of each of said at least one principal interior divider member is substantially two times the width of each of said original perimeter frame members.

8. The rectangular laminated master panel of claim 5 which includes at least one transverse interior divider member of rectangular cross section and integrally formed of a rigid solid material, said at least one transverse divider member (a) abutting at least two of said constituent segments of said foam core, (b) having the same thickness, measured perpendicularly to said original perimeter frame median plane, as said original perimeter members, (c) being positioned perpendicularly to said first mentioned at least one principal interior divider member, (d) having a longitudinal center line, said center line being spaced from an outer edge of said master panel perpendicular to said parallel original perimeter member by a distance that is a predetermined fraction of one of said predetermined length and width of said master panel, and (e) being severable along said center line to produce two subdivided perimeter members each of which members has an outwardly facing exterior surface with substantially the same thickness measured perpendicularly to said median plane of the original perimeter frame, and substantially the same surface characteristics as the aforementioned outwardly facing exterior surfaces of said original perimeter members, whereby severing said first mentioned at least one principal interior divider member and said at least one transverse divider member along their respective longitudinal center lines will produce a plurality of rectangular laminated subdivided panels, each of which subdivided panels has (i) a first dimension that is a first predetermined fraction of said predetermined length of said rectangular laminar master panel, (ii) a second dimension perpendicular to said first dimension that is a second predetermined fraction of said predetermined width of said rectangular laminated master panel, and (iii) a perimeter that has an outwardly facing exterior surface with substantially the same thickness and surface characteristics throughout its extent.

9. The laminated master panel of claim 1 in which at least one of said subdivided laminated panels is rectangular in shape.

10. The laminated master panel of claim 1 in which at least one of said subdivided laminated panels is trapezoidal in shape.

11. The laminated master panel of claim 1 in which at least one of said subdivided laminated panels is a parallelogram in shape.

12. The laminated master panel of claim 1 in which at least one of said subdivided laminated panels is circular in shape.

* * * * *